US006568948B2

(12) United States Patent
Matsuoka

(10) Patent No.: US 6,568,948 B2
(45) Date of Patent: May 27, 2003

(54) CONNECTOR

(75) Inventor: Hiroyuki Matsuoka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/090,069

(22) Filed: Mar. 1, 2002

(65) Prior Publication Data

US 2002/0123257 A1 Sep. 5, 2002

(30) Foreign Application Priority Data

Mar. 2, 2001 (JP) ..... 2001-059077
Jan. 31, 2002 (JP) ..... 2002-024582

(51) Int. Cl.[7] ..... H01R 13/52
(52) U.S. Cl. ..... 439/271; 439/752
(58) Field of Search ..... 439/271–283, 439/587, 588, 589, 752, 595

(56) References Cited

U.S. PATENT DOCUMENTS 4,973,268 A * 11/1990 Smith et al. ..... 439/595
5,328,382 A * 7/1994 Pawlicki ..... 439/273
5,692,929 A 12/1997 Hoffmann ..... 439/752
5,730,625 A * 3/1998 Sikora ..... 439/595
5,931,699 A * 8/1999 Saito ..... 439/587
6,193,551 B1 2/2001 Yamamoto et al. ..... 439/595

FOREIGN PATENT DOCUMENTS

JP 01-177877 12/1989
JP 03-205770 9/1991

* cited by examiner

*Primary Examiner*—P. Austin Bradley
*Assistant Examiner*—Ross Gushi
(74) *Attorney, Agent, or Firm*—Anthony J. Casella; Gerald E. Hespos

(57) ABSTRACT

A connector has a housing (10) with a terminal accommodating portion (11) that has cavities (19) in which terminal fittings (13) are accommodated. A lock (20) for locking the corresponding terminal fitting (13) projects from the upper surface of each cavity (19). A rubber ring (30) for making a connector watertight is mounted on the outer surface of the terminal accommodating portion (11). A holder (50) is mounted before the rubber ring (30) on the terminal accommodating portion (11) and has a front wall (51) for supporting the front ends of the terminal fittings (13) at their front-limit positions. The holder (50) has a holding plate (52) that holds the front surface of the rubber ring (30) to prevent the rubber ring (30) from coming off.

7 Claims, 13 Drawing Sheets

CONNECTOR

BACKGROUND OF THE INVENTION

1. Field of the Invention

The present invention relates to a connector.

2. Description of the Related Art

A known connector is shown in FIG. 18A, and includes a synthetic resin housing 1 and a cavity 2 that extends through the housing 1 in forward and backward directions. A resiliently deflectable lock 3 projects from an inner surface of the cavity 2 and a front stop wall 4 is formed at the front end of the cavity 3. A terminal fitting can be connected to an end of a wire and inserted into the cavity 2 from behind. Forces generated by the insertion of the terminal fitting deform the lock 3. However, the lock 3 resiliently returns to an undeflected condition when the terminal fitting reaches a proper depth. Thus, the lock 3 holds the terminal fitting in the cavity 2 with the front end of the terminal fitting abutted against the front-stop wall 4. The housing 1 is formed by molds 5, 6 that are placed before and behind the lock 3 and the front-stop wall 4. The molds 5, 6 then are withdrawn forward and backward after the molten resin in the molds 5, 6 has solidified.

U.S. Pat. No. 6,193,551 and FIG. 18B herein disclose an attempt to reduce the size of the above-described connector. The connector of FIG. 18B is formed by molding a part of a housing 1 that includes the lock 3 and separately molding a part of the housing 1 that includes the front-stop wall 4. The two parts then are assembled together. This connector eliminates an undesirable reduction in the area of the front-stop wall 4 caused by the fact that the mold 5 in front of the lock 3 in the above connector is withdrawn as shown in FIG. 18(A). Thus, the front-stop wall 4 is secure even if the width of the cavity 2 becomes smaller. In this connector as well, the lock 3 and left and right side walls 7 adjacent to the lock 3 are spaced apart to permit the resilient deformation of the lock 3.

A known connector used in an environment that requires a watertight fit has a rubber ring mounted on an outer surface of a housing. The rubber ring then is squeezed between engaging surfaces of the housing and a mating housing. However, there is a concern that the rubber ring may be displaced forward or, in a worse case, may come off when the housings are separated. Additionally, a demand exists for smaller watertight connectors.

The present invention was developed in view of the above situation, and an object thereof is to provide a connector that can suitably meet a request to be made smaller and to maintain a good operability.

SUMMARY OF THE INVENTION

The invention is directed to a connector that has a housing with at least one cavity into which a terminal fitting is insertable. A sealing ring is mounted on an outer surface of the housing and closely contacts the housing. A mating housing is fittable on the outer side of the housing and the sealing ring is squeezed between two housings to provide a watertight seal between the housings. The connector further includes a holder mounted on the housing and provided with a stop wall for supporting the terminal fitting in the cavity at a limit position of the terminal fitting. The holder further has a sealing ring holding portion for engaging the sealing ring from a fitting direction and holding the sealing ring on the housing. Accordingly, the connector can be small, but also prevents a sealing ring from coming off.

A lock may project from an inner surface of the cavity for locking the terminal fitting that has been inserted to a proper depth in the cavity.

The holder is mountable on the housing main body from the front, and the stop wall is preferably a front-stop wall for supporting the terminal fitting inserted into the cavity at a front-limit position.

The holder with the front-stop wall is formed separately from the housing. Thus, it is not necessary to reduce the area of the front wall to remove the mold that molds the lock. Accordingly, the front wall can be secure even if the cavity is made smaller. Further, the rubber ring can be held securely in place by the rubber ring holding portion.

A retainer mount hole is formed in one side wall of the housing and intersects the cavity. A retainer is mountable in the retainer mount hole and is configured to lock the terminal fitting in the cavity. The retainer preferably comprises an auxiliary rubber ring holding portion for holding the rubber ring by engaging the rubber ring from the front.

The auxiliary rubber ring holding portion cooperates with rubber ring holding portion of the holder for holding the rubber ring more securely.

The retainer preferably is movable in the retainer mount hole between a partial locking position and a full locking position. The retainer has at least one locking piece that is retracted from the cavity to permit the insertion and withdrawal of the terminal fitting into and from the cavity when the retainer is in the partial locking position. However, the locking piece projects into the cavity to engage the terminal fitting when the retainer is in the full locking position. The auxiliary rubber ring holding portion preferably is formed by front and rear ends of the retainer with respect to the inserting direction of the retainer. The rear end of the retainer is engaged with the rubber ring from the front when the retainer is at the partial locking position. However, both the front and rear ends of the retainer are engaged with the rubber ring from the front when the retainer is at the full locking position to hold the rubber ring.

The retainer is mounted at the partial locking position in the retainer mount hole before the terminal fitting is inserted into the cavity, and the rear end of the retainer engages the rubber ring to prevent the rubber ring from coming off. The retainer is moved to the full locking position after the terminal is inserted into the cavity. Thus, the locking piece engages and locks the terminal fitting, and both the front and rear ends of the retainer engage the rubber ring. Thus, the rubber ring can be held more firmly.

The holder preferably comprises partition walls that are insertable adjacent the locks along a direction substantially normal to the direction of resilient deformation of the locks. The partition walls are inserted substantially to the base ends of the locks, and form side walls between the cavities that insulate the terminal fitting from other terminal fittings.

The partition walls at the sides of the locks are part of the holder. Thus, clearances between the locks and the partition walls can be made smaller independently of molds used for molding the housing. As a result, the connector can be made smaller.

The housing may have positioning portions that engage the corresponding partition walls and extending along an inserting direction of the partition walls.

Portions of adjacent cavities preferably are divided at least partly by housing partition walls. The respective holder partition walls are insertable into notches in the housing partition wall.

These and other objects, features and advantages of the present invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

Figure 3:
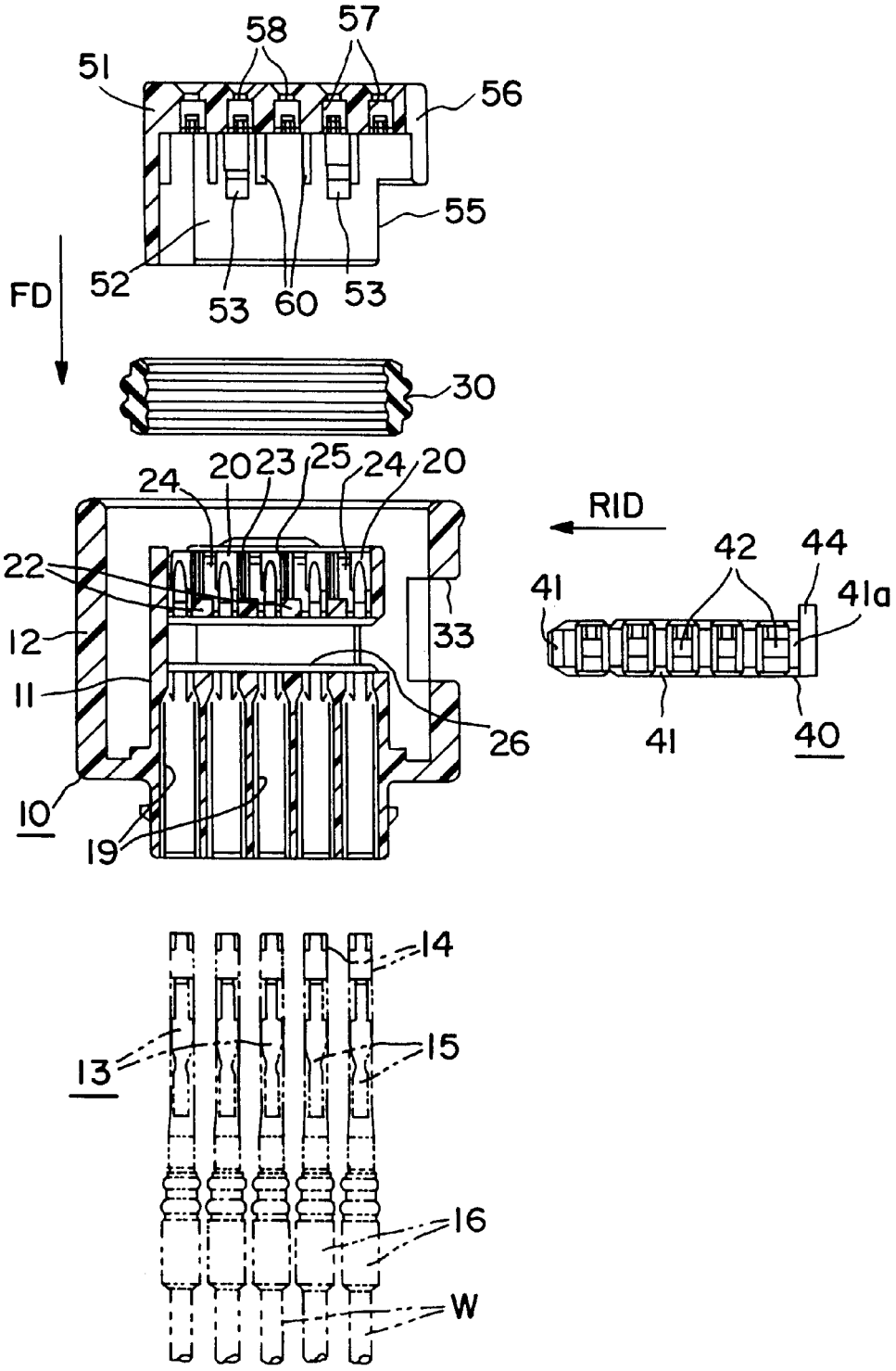
FIG. 3 is a section along 3—3 of FIG. 1 showing an exploded state of a female connector.
Figure 4:
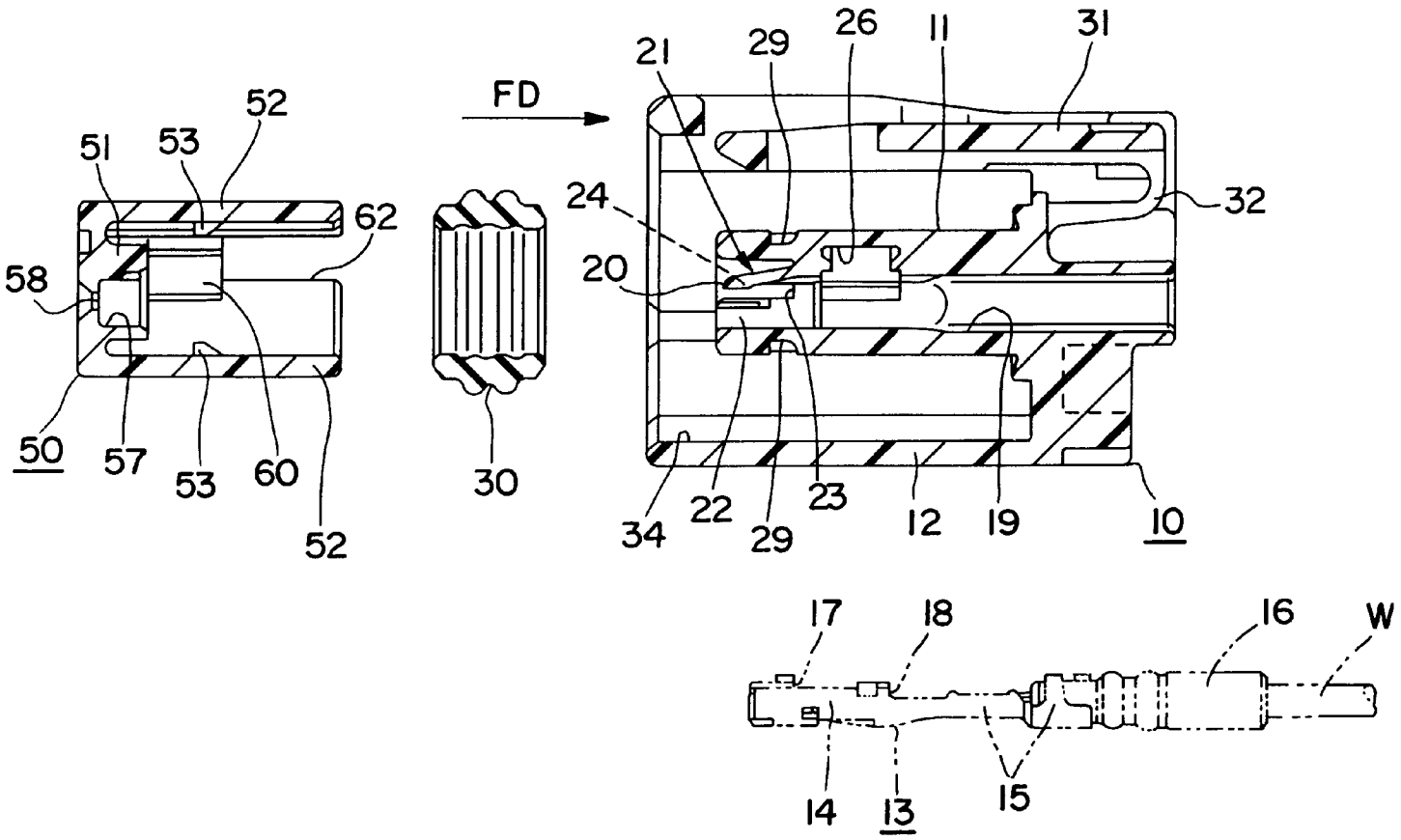
FIG. 4 is a section along 4—4 of FIG. 1 showing the exploded state of the female connector.

A connector in accordance with the invention includes a synthetic resin housing 10, as shown in FIGS. 3 and 4. The housing 10 has a terminal accommodating portion 11 and a receptacle 12 that at least partly surrounds the terminal accommodating portion 11.

The connector further includes five terminal fittings 13. However, more or fewer terminal fittings 13 may be provided in other embodiments. Each terminal fitting 13 has a substantially box-shaped connecting portion 14 and a barrel 15 that can be crimped into connection with an end of a wire W. A rubber plug 16 is fitted on an end of an insulation coating of the wire W and is fixed by the crimping of the barrel portion 15. An engaging portion 17 projects up from the top surface of the connecting portion 14 of the terminal fitting 13.

The terminal fittings 13 are inserted from behind into cavities 19 that are arrayed side-by-side in the terminal accommodating portion 11. A front half of each cavity 19 has a substantially rectangular cross section that conforms to the shape of the connecting portion 14 of the terminal fitting 13. A rear half of each cavity 19 has a circular cross section that conforms to the shape of the rubber plug 16. Thus, the rubber plug 16 is held in close contact with the inner circumferential surface of the cavity 19 to protect the inside of the cavity 19 from water. A lock 20 is cantilevered obliquely forward from an upper front position of each cavity 19. The lock 20 is deformed temporarily in a deformation direction into a deformation permitting space 21 above the terminal fitting 13 in response to forces exerted during insertion of the terminal fitting 13 into the cavity 19. However, the lock 20 is restored resiliently or elastically substantially to its original shape when the terminal fitting 13 reaches a proper depth. Thus, the lock 20 engages the engaging portion 17 that projects from the upper surface of the connecting portion 14. At this time, the terminal fitting 13 is accommodated in the cavity 19 and the front end of the terminal fitting 13 projects forward from the terminal accommodating portion 11.

Figure 1:
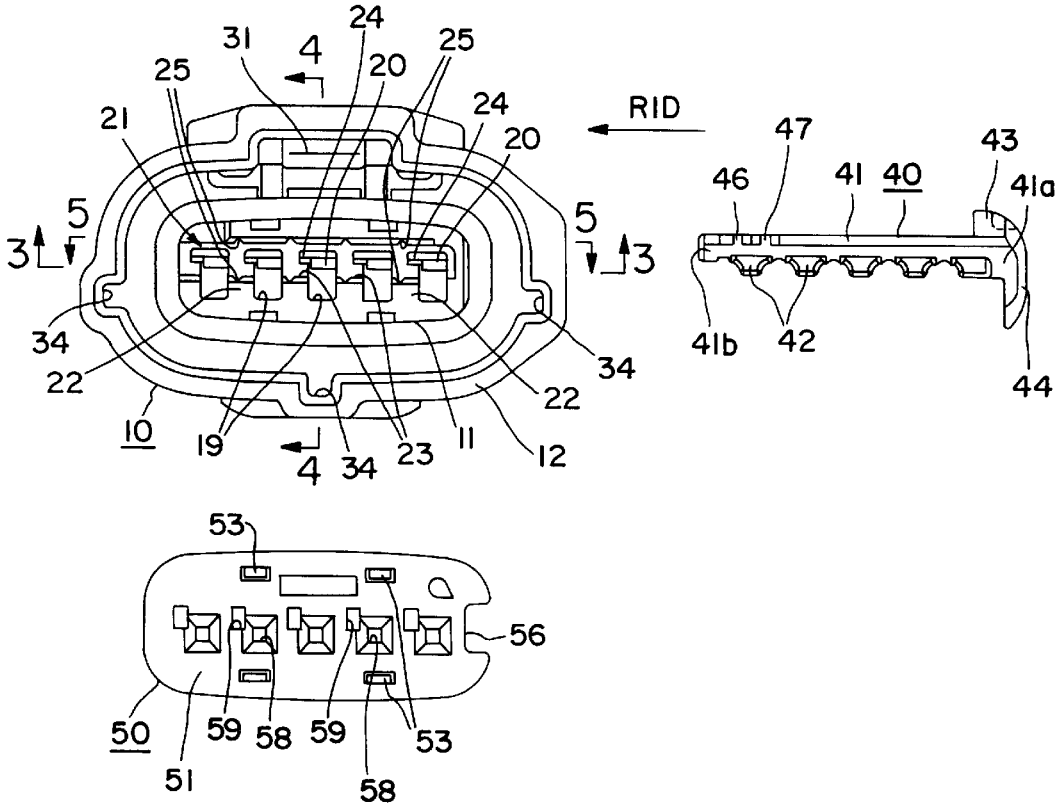
FIG. 1 is a front view of a housing, a holder and a retainer according to one embodiment of the invention.

Partition walls 22 partition the front halves of adjacent cavities 19 and are slightly narrower than the front halves of the cavities 19. Each partition wall 22 is formed with a notch 23 that opens forwardly from the base end of the corresponding lock 20. As shown in FIG. 1, each notch 23 extends over more than half the height of the partition wall 22 from the upper end of the partition wall 22 to a position below the bottom end of the corresponding lock 20. An unlocking piece 24 is coupled to the left side of each lock 20 and extends over substantially its entire length from the back end surface of each notch 23, as shown in FIG. 1. The unlocking pieces 24 are about half as wide as the notches 23. The lock 20 can be deformed by pressing the unlocking portion 24 with a jig or the like to disengage the lock 20 from the terminal fitting 13. Substantially V-shaped positioning grooves 25 are formed in the upper and bottom surfaces of the notches 23.

Figure 5:
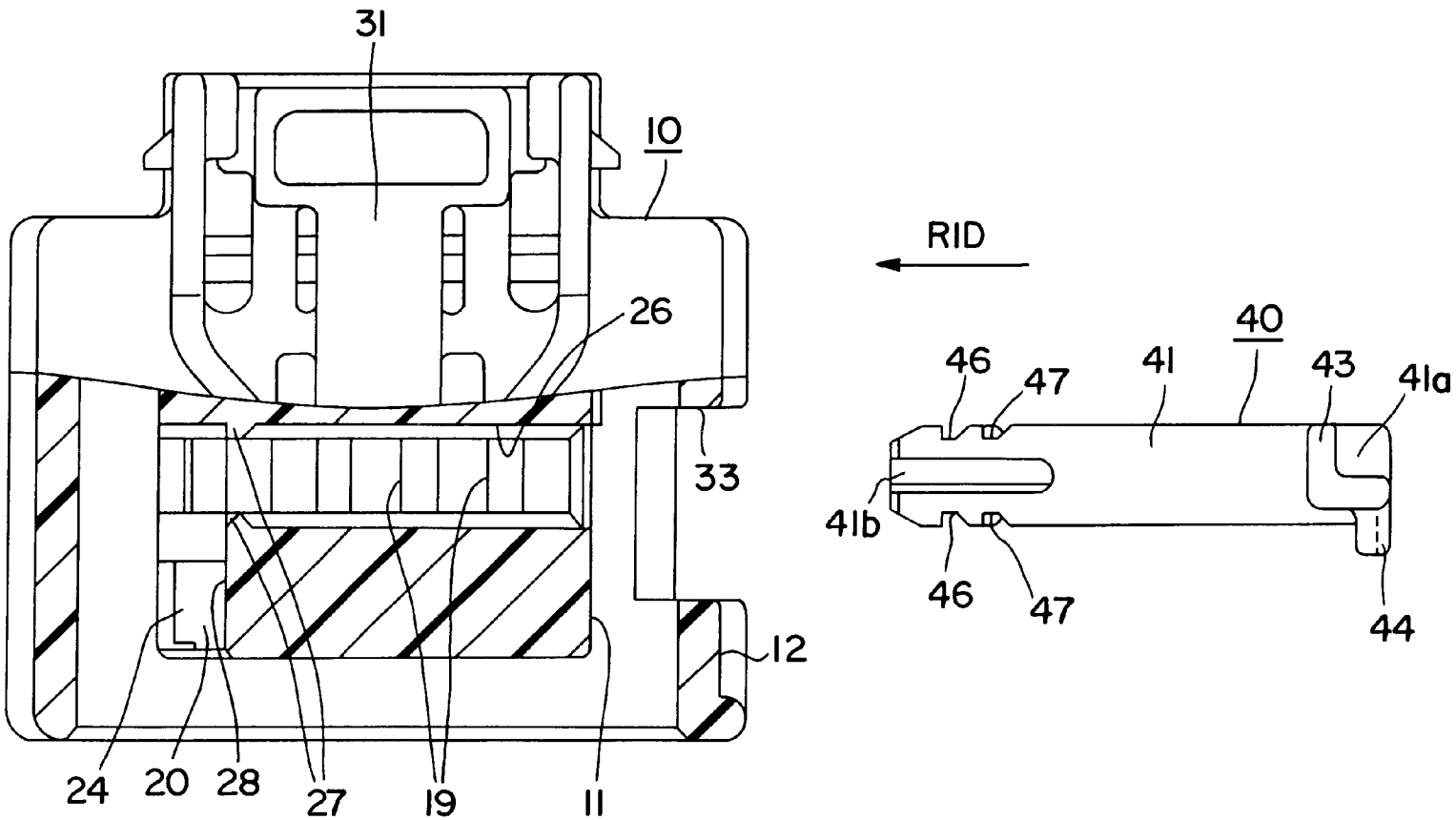
FIG. 5 is a section along 5—5 of FIG. 1 showing the housing and the retainer.

A retainer mount hole 26 penetrates the terminal accommodating portion 11 transversely at a location slightly behind the locks 20. Thus, the retainer mount hole 26 communicates with the respective cavities 19, as shown in FIGS. 3 and 4. Front and rear holding projections 27 are formed in the retainer mount hole 26 at a location remote from the entry, as shown in FIG. 5. A mold removal hole 28 extends from the front end of the terminal accommodating portion 11 to the retainer mount hole 26 for forming the surfaces of the holding projections 27 that face away from the entrance to the terminal mount hole 26. Holding grooves 29 extend transversely across upper and lower surfaces of the terminal accommodating portion 11, as shown in FIG. 4. Additionally, slanted surfaces are formed at each of the upper and lower inner surfaces at the front end of the terminal accommodating portion 11.

The receptacle 12 is a forwardly open rectangular tube that is coupled to the terminal accommodating portion 11 by a coupling portion that bulges out from the outer surface near the rear of the terminal accommodating portion 11. A mating male connector (not shown) is insertable from the front into the space between the receptacle 12 and the terminal accommodating portion 11. A rubber ring 30 is fitted on the outer surface of the terminal accommodating portion 11 in a fitting direction FD and can be squeezed between the terminal accommodating portion 11 and the male connector to provide a watertight fit between the two connectors.

A lock arm 31 is provided substantially at the widthwise center of the upper part of the receptacle 12 for holding the male connector. The lock arm 31 has a rear end coupled to the terminal accommodating portion 11 by a pair of support arms 32 and has opposite lateral edges partially coupled to the receptacle 12, as shown in FIG. 5. Thus, the lock arm 31 is supported for vertical resilient displacement.

Figure 2:
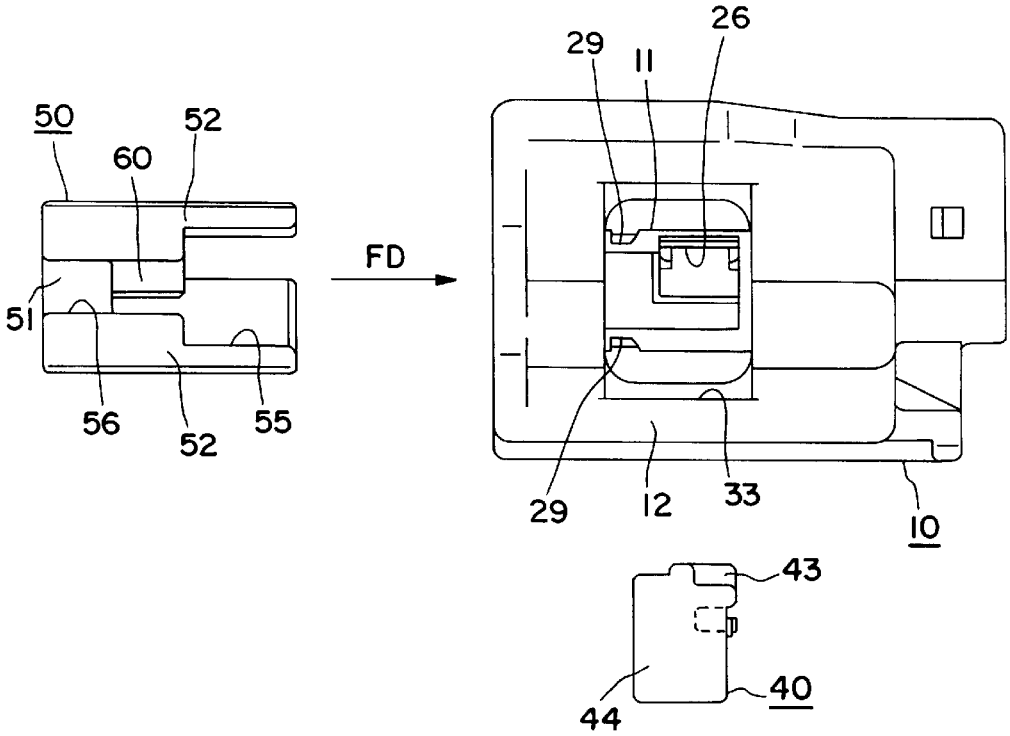
FIG. 2 is a side view of the housing, the holder and the retainer.

A retainer insertion hole 33 opens sideways in the right side of the receptacle 12, as shown in FIG. 5. As shown in FIG. 2, the retainer mount hole 26 of the terminal accommodating portion 11 and the holding grooves 29 are exposed to the outside at the retainer insertion hole 33. The retainer insertion hole 33, the retainer mount hole 26 and the holding grooves 29 all are formed by the same mold when the housing main body 10 is molded. Further, the opposite sides and the bottom of the receptacle 12 are formed to bulge out as shown in FIG. 1, thereby forming three guide grooves 34 for guiding the connection of the male connector.

The retainer 40 is made e.g. of a synthetic resin and has a narrow plate-shaped base 41 that can be inserted into the retainer mount hole 26. Five locking projections 42 are formed on the lower surface of the base 41 and project into the cavities 19 to engage the terminal fittings 13. The locking projections 42 are arrayed at intervals that conform with the intervals of the cavities 19. A mount-maneuvering projection 43 is provided on the upper surface of a rear end 41*a* of the base 41 with respect to an inserting direction RID of the retainer 40 into the terminal accommodating portion 11 and can be pushed from the side by a jig. A thin detach-maneuvering piece 44 also is on the front surface of the rear end 41*a* of the base 41 with respect to the inserting direction RID thereof, and can be pushed from the front by a jig when the retainer 40 is detached. Further, the rear surface of the rear end 41*a* of the retainer 40 with respect to the inserting direction RID thereof is formed moderately arcuate.

Two first holding recesses 46 are formed in the lateral surfaces of the base 41, and two second holding recesses 46 are formed between the first holding recesses 46 and the detach-maneuvering piece 44, as shown in FIG. 5. Thus, the retainer 40 can be held in a partial locking position in the terminal accommodating portion 11 by engaging the first holding recesses 46 with the holding projections 27 in the retainer mount hole 26 or in a full locking position by engaging the second holding recesses 47 with the holding projections 27.

Figure 8:
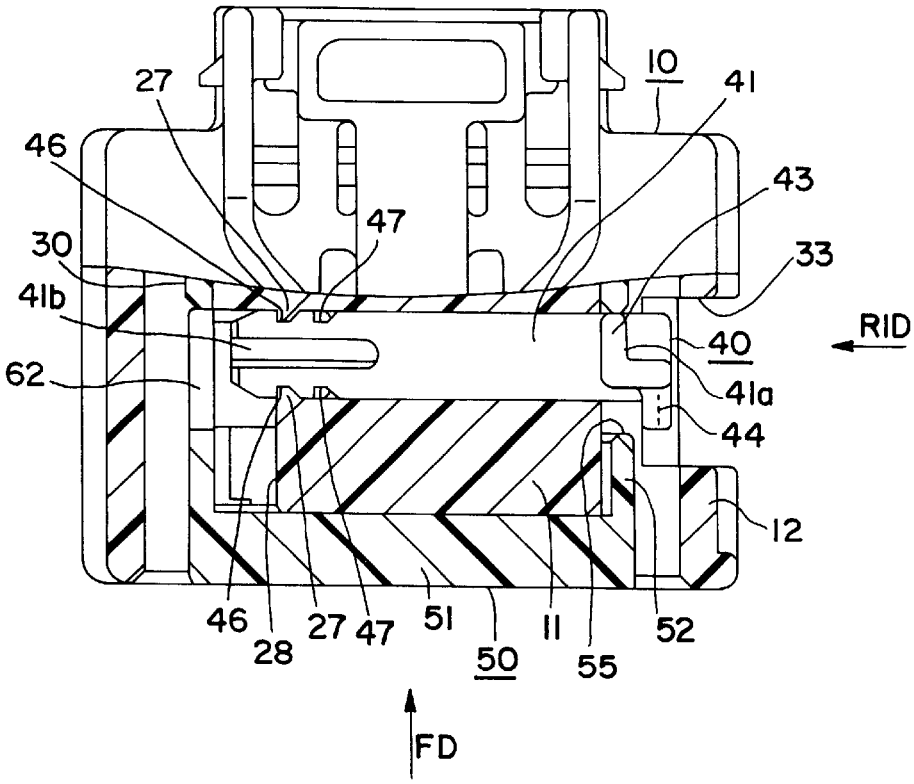
FIG. 8 is a section along 8—8 of FIG. 7.
Figure 10:
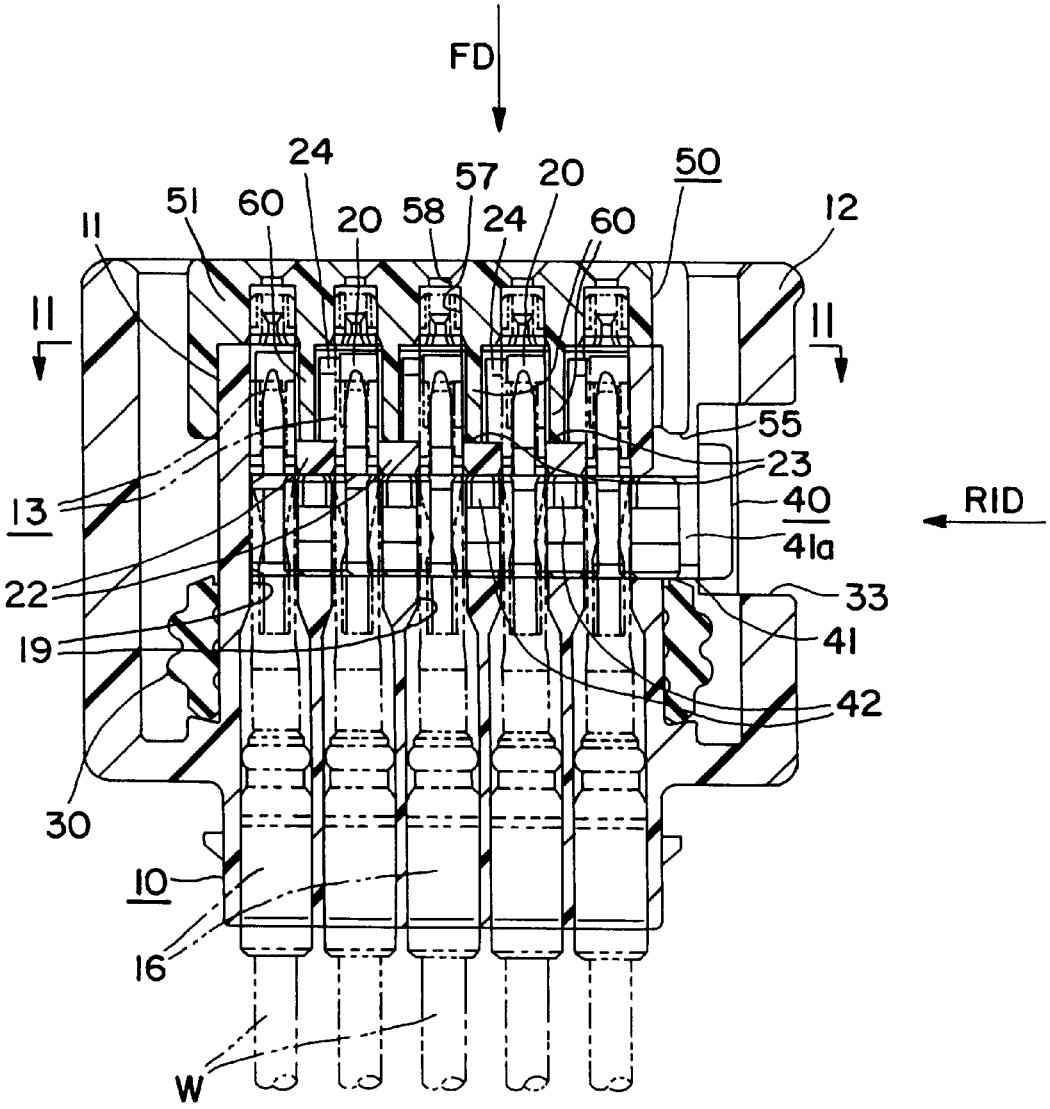
FIG. 10 is a section along 10—10 of FIG. 7.

The locking projections 42 are retracted from the cavities 19 and are at substantially the same positions as the partition walls 22 when the retainer 40 is at the partial locking position, as shown in FIGS. 8 and 10. Thus, the terminal fittings 13 can be inserted into and withdrawn from the cavities 19. Additionally, the rear end 41*a* of the retainer 40 with respect to the inserting direction RID is engaged in the fitting direction FD with the front end of the rubber ring 30, as shown in FIGS. 8 and 10, to lock the rubber ring 30 in place.

Figure 13:
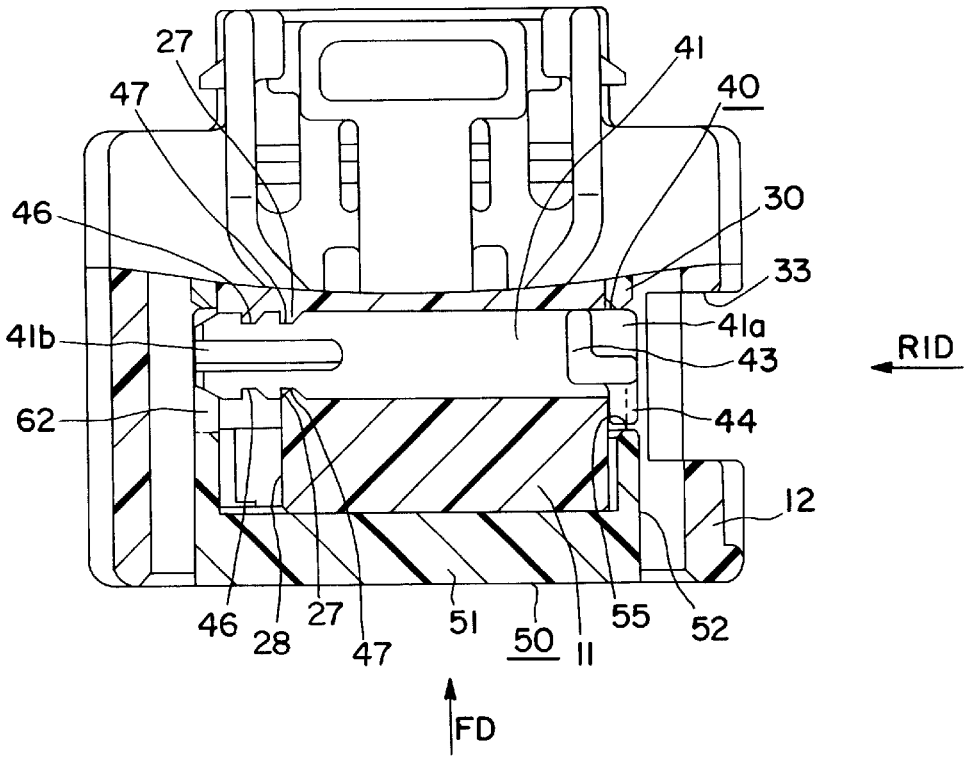
FIG. 13 is a section along 13—13 of FIG. 12.
Figure 14:
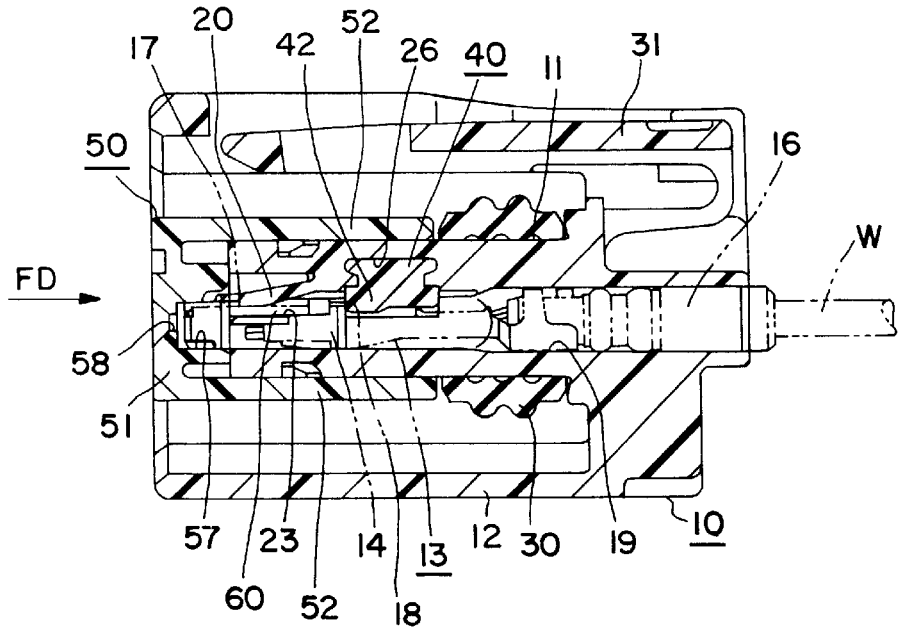
FIG. 14 is a section along 14—14 of FIG. 12.
Figure 15:
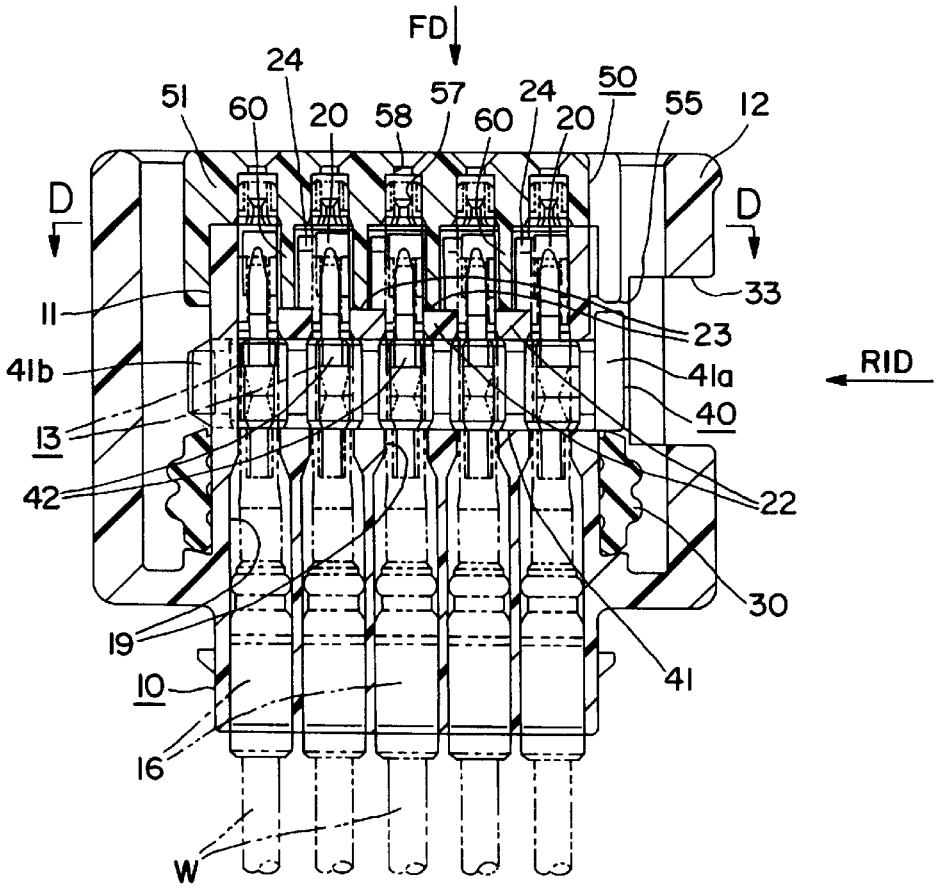
FIG. 15 is a section along 15—15 of FIG. 12.
Figure 16:
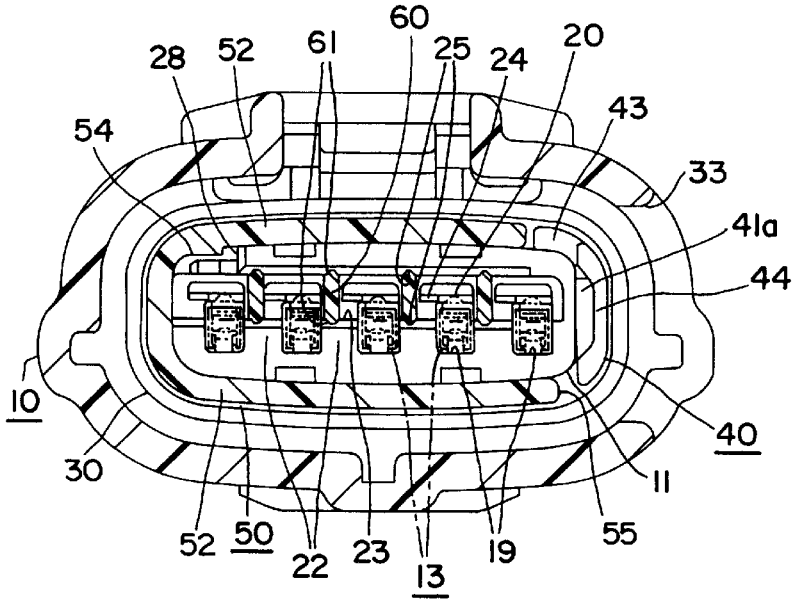
FIG. 16 is a section along 16—16 of FIG. 15.

The retainer 40 can be moved into the full locking position in the retainer mount hole 26 to engage the second holding recesses 47 with the holding projections 27, as shown in FIG. 13. In this state, the respective locking projections 42 enter the cavities 19 to engage the jaws 18 at the rear ends of the connecting portions 14 of the terminal fittings 13, as shown in FIG. 14. The base 41 of the retainer 40 has a front end 41*b* that projects laterally beyond the side of the terminal accommodating portion 11 opposed to the side that has the retainer insertion hole 33, as shown in FIGS. 13 and 15. The front end 41*b* of the base 41 is engaged along the fitting direction FD with the front surface of the rubber ring 30 to prevent the rubber ring 30 from coming off forward. At this full locking position, the rear end 41*a* of the base 41 also is engaged with the front surface of the rubber ring 30. The locking projections 42 are slightly narrower than the partition walls 22. Thus, the locking projections 42 engage the jaws 18 of the terminal fittings 13 substantially over the entire width.

Figure 6:
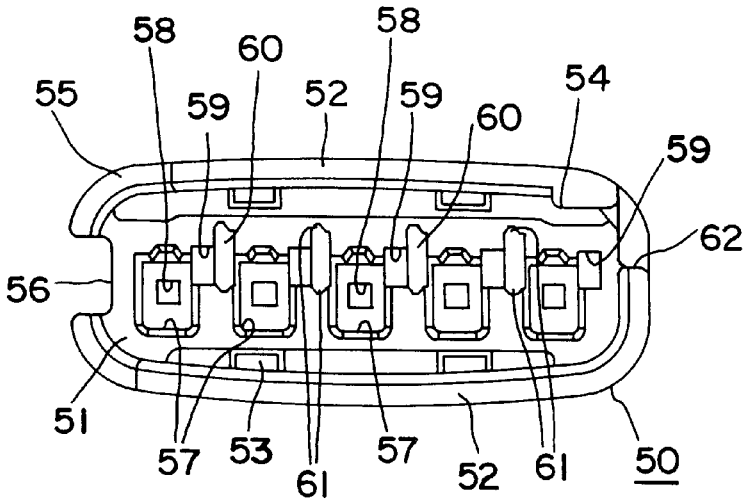
FIG. 6 is a rear view of the holder.
Figure 11A:
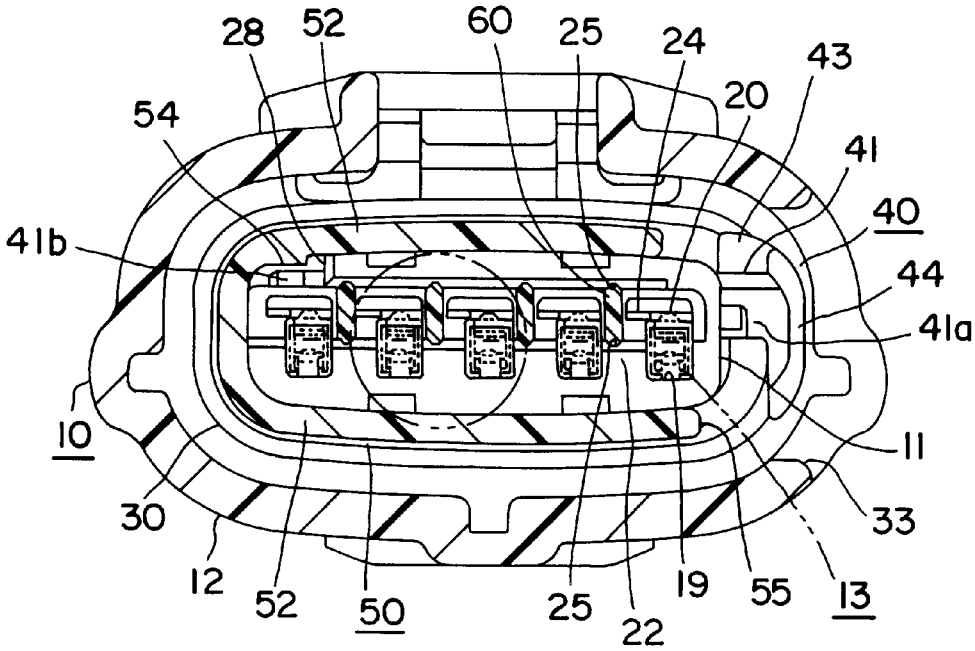
FIG. 11 is a section along 11—11 of FIG. 10.
Figure 11B:
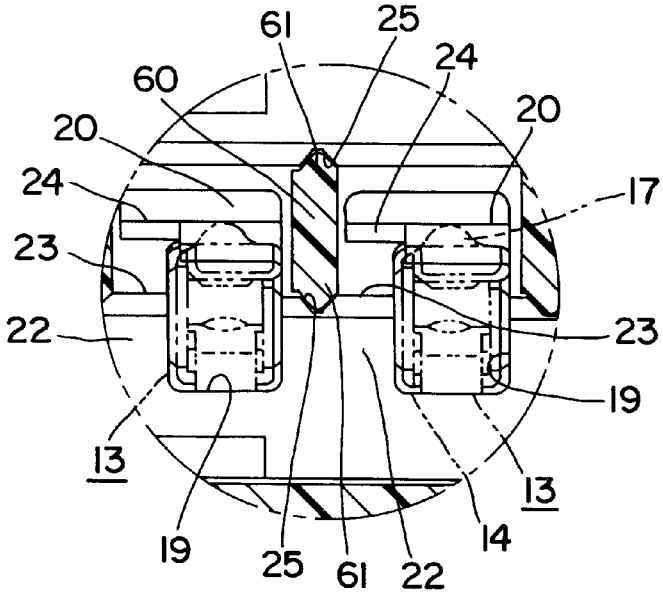
Figure 12:
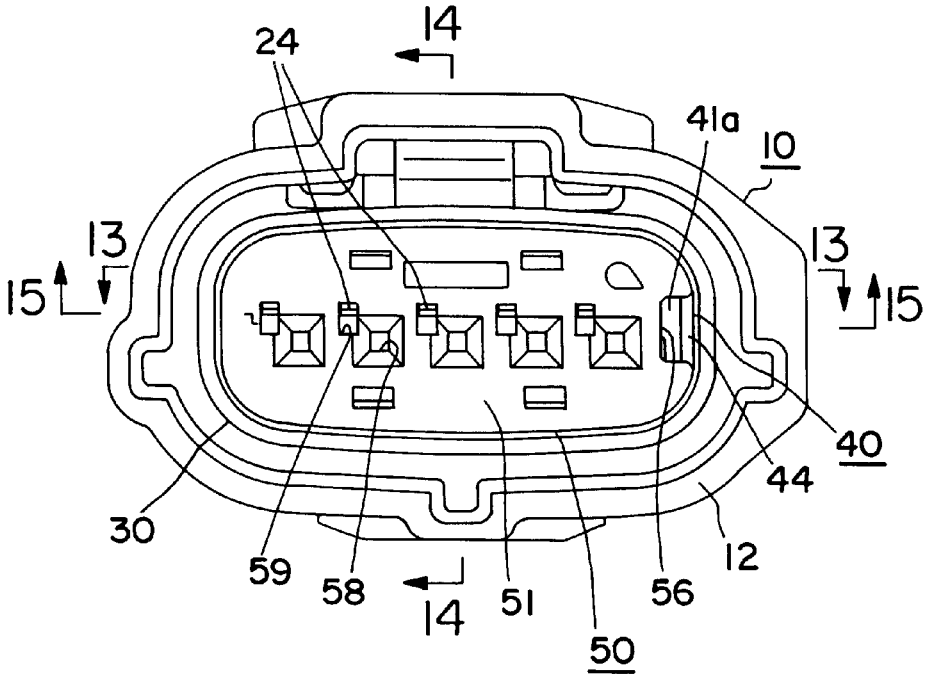
FIG. 12 is a front view showing a state where the retainer is at a full locking position.

A synthetic resin holder 50 has a substantially elliptical front wall 51 and a substantially tubular holding plate 52 that projects back from the front wall 51, as shown in FIG. 6. The holding plate 52 is fittable in a fitting direction FD on the outer surface of the terminal accommodating portion 11, as shown in FIG. 4. Two holding projections 53 are provided on each of the upper and lower inner surfaces of the holding plate 52. The holder 50 is held to the terminal accommodating portion 11 by engaging the holding projections 53 with the holding grooves 29 in the terminal accommodating portion 11. In this state, the holding plate 52 engages the front surface of the rubber ring 30 and prevents the rubber ring 30 from coming off (see FIG. 9). A bulge 54 is formed on the inner surface of the holding plate 52, as shown in FIG. 6, and is dimensioned and disposed to enter the mold-removal hole 28 of the terminal accommodating portion 11, as shown in FIG. 11. A communicating portion 55 opens laterally in the left end of the holding plate 52 in FIG. 6, and communicates with the retainer mount hole 26 and the retainer insertion hole 33. A jig insertion recess 56 is formed in the front wall 51 before the communicating portion 55, as shown in FIG. 12. The jig insertion recess 56 allows the detach-maneuvering piece 44 of the retainer 40 to be exposed to the front when the retainer 40 is at the full lock position and permits insertion of a jig to manipulate the detach-maneuvering piece 44. An escaping recess 62 is formed at a side of the holding plate 52 opposite from the communicating portion 55, as shown in FIG. 6. The escaping recess 62 enables the front end 41*b* of the base 41 to project laterally beyond the terminal accommodating portion 11, as shown in FIG. 13, when the retainer 40 is in the full locking position.

Figure 7:
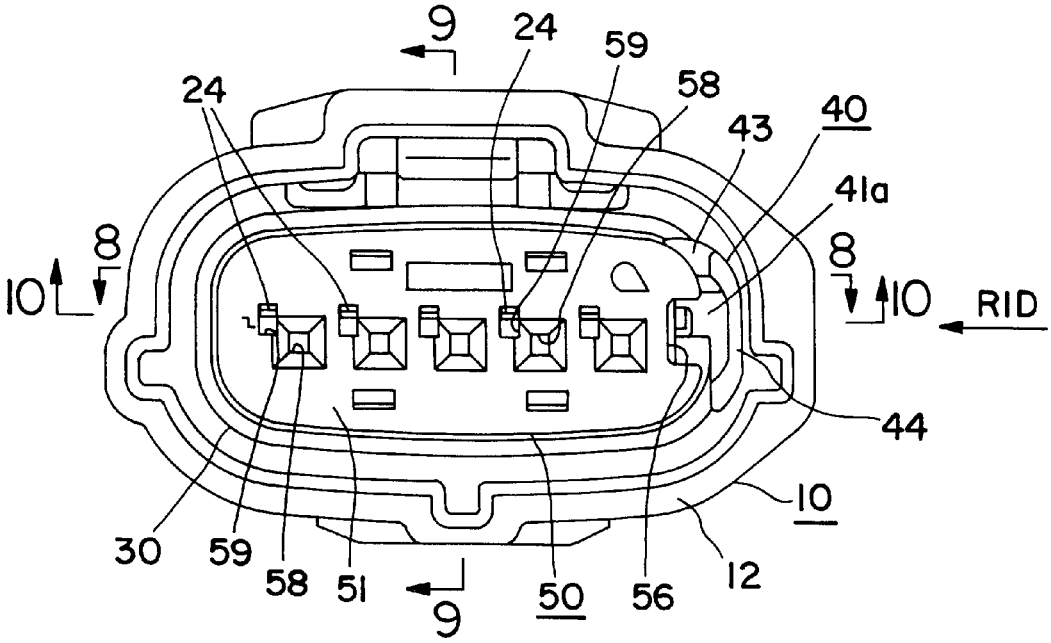
FIG. 7 is a front view showing the retainer mounted at a partial locking position on the housing with the holder also mounted on the housing.

Fitting recesses 57 are formed in the front wall 51 of the holder 50, as shown in FIGS. 3 and 4. The fitting recesses 57 correspond in number to the number of cavities 19 and terminal fittings 13, and are formed side-by-side at positions in conformity with the intervals of the cavities 19. Thus, the fitting recesses 57 receive the front ends of the corresponding terminal fittings 13 that project forward from the terminal accommodating portion 11 and prevent the terminal fittings 13 from moving loosely in vertical, horizontal and forward directions. Insertion holes 58 are formed in the centers of the respective fitting recesses 57 of the front wall 51, as shown in FIG. 6, and accommodate the male terminal fittings of the mating male connector. Jig insertion holes 59 penetrate the front wall 51 along the insertion direction of the terminal fittings 13 and communicate with the upper right portions of the fitting recesses 57 in FIG. 6. The jig insertion holes 59 are formed at positions to expose the unlocking pieces 24 of the locks 20 and to permit insertion of the jig from the front to manipulate the unlocking pieces 24 as shown in FIG. 7. The jig insertion holes 59 are formed at positions obliquely displaced from the insertion holes 58. Thus, the male terminal fittings are unlikely to enter the jig insertion holes 59 erroneously, even if the mating male connector is inclined during connection.

Partition walls 60 project back from the rear surface of the front wall 51 at the right sides of the jig insertion holes 59 and at the left sides of the fitting recesses 57 in FIG. 6. The partition walls 60 are insertable into the respective notches 23 as the holder 50 is mounted on the terminal accommodating portion 11 and completely close the notches 23, as shown in FIG. 11. Thus, the partition walls 60 insulate the terminal fittings 13 in adjacent cavities 19 from each other, and the side surfaces of the partition walls 60 form parts of the side surfaces of the cavities 19. The partition walls 60 are about half as wide as the partition walls 22 and, accordingly, minimum clearances are provided between the partition walls 60 and the locks 20 or the unlocking pieces 24 so as not to hinder resilient deformation of the locks 20. More specifically, the left side surfaces of the partition walls 60 in FIG. 10 are slightly recessed from inner side surfaces of the fitting recesses 57 and the cavities 19.

Substantially triangular positioning projections 61 project up and down from upper and lower ends of each partition wall 60, as shown in FIG. 11. The partition walls 60 engage the V-shaped positioning grooves 25 in the notches 23 to prevent lateral displacement of the partition walls 60. More specifically, small horizontal portions that are continuous with the positioning projections 61 remain at the upper and lower left surfaces of the partition walls 60 in FIG. 11, and are held in contact with the upper and lower surfaces of the notches 23.

Figure 9:
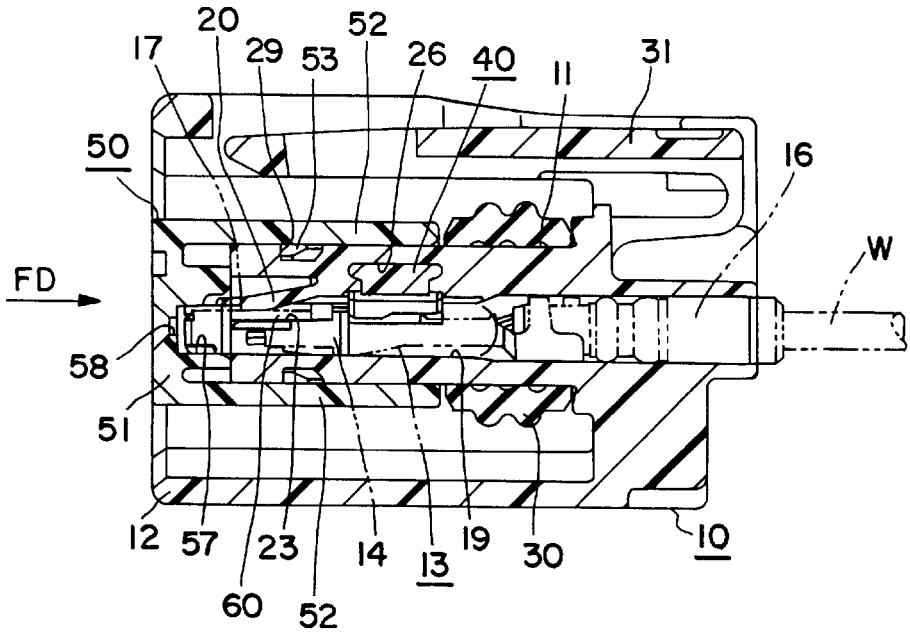
FIG. 9 is a section along 9—9 of FIG. 7.

The female connector is assembled by first mounting the rubber ring 30 from the front on the outer surface of the terminal accommodating portion 11 and then mounting the inner circumferential surface of the holding plate 52 of the holder 50 on the outer surface of the terminal accommodating portion 11. The holding projections 53 move onto the slanted surfaces and enter the holding grooves 29, as shown in FIG. 9. As a result, the front end surfaces of the holding projections 53 engage the front end surfaces of the holding grooves 29 to retain the holder 50 on the terminal accommodating portion 11. At this stage, the rear surface of the holder 50 engages the front end surface of the rubber ring 30 to hold the rubber ring 30 in position. During this process, the respective partition walls 60 are inserted in the fitting direction FD into the corresponding notches 23, and the upper and lower positioning projections 61 enter the corresponding positioning grooves 25, as shown in FIGS. 10 and 11, to position the partition walls 60 laterally. The partition walls 60 are inserted smoothly into the notches 23 without interfering with the locks 20 or the unlocking pieces 24. The partition walls 60 are inserted sufficiently for their rear ends to contact the back ends of the respective notches 23 and to align with the base ends of the locks 20. Thus, the partition walls 60 partition adjacent cavities 19 and form the side surfaces of the cavities 19. In this state, the front end surface of the holder 50 and the front end surface of the housing 10 are substantially flush with each other.

The retainer 40 then is inserted from one side of the housing 10 through the retainer insertion hole 33 of the receptacle 12 and into the retainer mount hole 26 of the terminal accommodating portion 11. As shown in FIG. 8, the retainer 40 is held at the partial locking position when the base 41 is inserted until the first holding recesses 46 engage the holding projections 27. At this stage, the rear end 41*a* of the retainer 40 with respect to the inserting direction RID is between the holder 50 and the receptacle 12 and can be seen from the front as shown in FIG. 7. Further, at this partial locking position, the rear end 41*a* of the base 41 of the retainer 40 is in the communicating portion 55 of the holder 50 and is engaged with the front end surface of the rubber ring 30, as shown in FIGS. 8 and 10. Thus, the rear end 41*a* of the base 41 cooperates with the holding plate 52 of the holder 50 to hold the rubber ring 30 in place. It does not matter which of the holder 50 and the retainer 40 is mounted first.

The terminal fittings 13 then are inserted into the cavities 19. The connecting portions 14 of the terminal fittings 13 push the locks 20 at an intermediate stage of insertion, and temporarily deform the locks 20 into the deformation permitting spaces 21. The locks 20 are restored resiliently and engage the engaging portions 17 when the terminal fittings 13 reach a proper depth to partly lock the terminal fittings 13, as shown in FIG. 9. At this time, the front ends of the terminal fittings 13 are in the fitting recesses 57 of the holder 50, as shown in FIGS. 9 and 10. As a result, the terminals 13 are supported and will not move forward any further. The accommodated terminal fittings 13 are insulated from the terminal fittings 13 in adjacent cavities 19 because the partition walls 60 substantially close the notches 23.

The retainer 40 is moved to the full locking position after all of the terminal fittings have been mounted in the cavities 19. At this time, the mount-maneuvering projection 43 of the retainer 40 is pushed by a jig inserted sideways through the retainer insertion hole 33 to push the retainer 40. Thus, the first holding recesses 46 disengage from the holding projections 27, and the second holding recesses 47 engage the holding projections 27 as shown in FIG. 13. As a result, the locking projections 42 of the retainer 40 project into the cavities 19 to engage the jaws 18, thereby doubly locking the terminal fittings 13, as shown in FIGS. 14 and 15.

The rear end 41*a* of the retainer 40, excluding the detach-maneuvering piece 44, becomes concealed by the holder 50 and cannot be seen from front when the retainer reaches the full locking position. Thus, an operator can detect that the retainer 40 has reached the full locking position. In this state, the rear surface of the retainer 40 is substantially flush with the side surface of the holding member 50. Additionally, the front end 41*b* of the base 41 of the retainer 40 projects laterally beyond the side of the terminal accommodating portion 11 opposite the retainer insertion hole 33 and into the escaping recess 62 of the holder 50 for engagement with the front end surface of the rubber ring 30. Further, the rear 41*a* of the base 41 is in the communicating portion 55 of the holder 50 and engages the front surface of the rubber ring 30, as shown in FIGS. 13 and 15. Thus, the front and rear ends 41*b*, 41*a* of the base 41 engage the front surface of the rubber ring 30 together with the holding plate 52 of the holder 50, and the rubber ring 30 is held securely. In other words, the holding plate 52 is notched to define the communicating portion 55 and the escaping recess 62 for the mounting of the retainer 40, and these notched portions cannot hold the rubber ring 30. However, the holding plate 52 can be supplemented at the communicating portion 55 and the escaping recess 62 by the front and rear ends 41*b*, 41*a* of the base 41 of the retainer 40, and the rubber ring 30 can be held more firmly.

The terminal fittings 13 can be removed for maintenance or another reason by first manipulating the detach-maneuvering piece 44 of the retainer 40 with a jig inserted through the jig insertion recess 56 of the holder 50 to move the retainer 40 from the full locking position to the partial locking position. Thereafter, a different jig is inserted into the jig insertion hole 59 of the holder 50 from the front. The second jig is urged against the unlocking piece 24 to disengage the lock 20 from the engaging portion 17. The terminal fitting 13 then is pulled out of the cavity 19.

As described above, the front wall 51 is provided on the holder 50 for supporting the terminal fittings 13 at their front-limit positions and is separate from the housing 10. Accordingly, it is not necessary to reduce an area of the front wall 51 for the removal of the mold for molding the locks 20. Thus, the front wall 51 can have a sufficiently large area even if the cavities 19 are made smaller, and the connector also can be made smaller. Further, the rubber ring 30 can be held by the holding plate 52 of the holder 50 so as not to displace. Furthermore, the construction of the connector can be simplified as compared to a case where a locking member specially tailored for the rubber ring 30 separately from the holder 50.

The rubber ring 30 can be held more firmly by the front and rear ends 41*b*, 41*a* of the base 41 of the retainer 40 in addition to the holding plate 52 of the holder 50. More specifically, the rear end 41*a* of the base 41 is engaged with the rubber ring 30 when the retainer 40 is at the partial locking position, whereas both the front and rear ends 41*b*, 41*a* of the base 41 are engaged with the rubber ring 30 when the retainer 40 is at the full locking position.

The present invention is not limited to the above described and illustrated embodiment. For example, following embodiments are also embraced by the technical scope of the invention as defined in the claims. Beside the following embodiments, various changes can be made without departing from the scope and spirit of the invention as defined in the claims.

Figure 17:
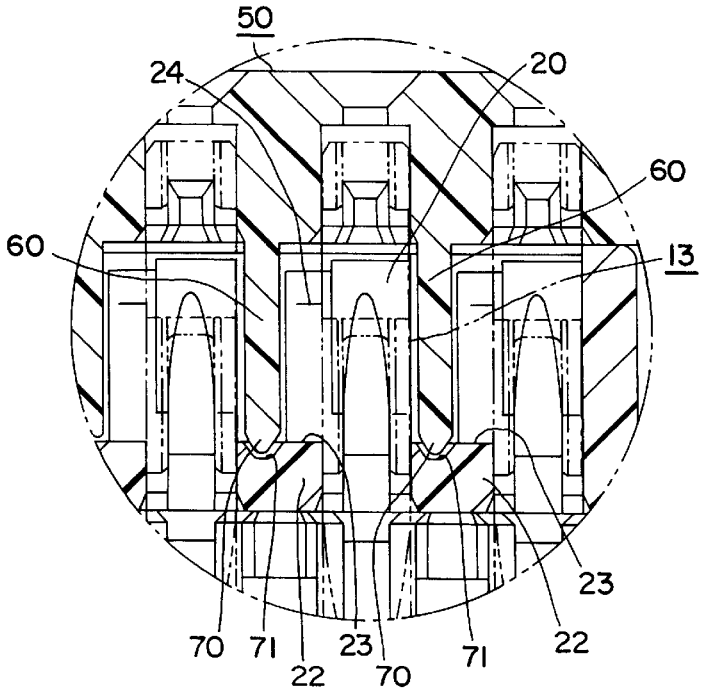
FIG. 17 is an enlarged horizontal section of a modification.
Figure 18A:
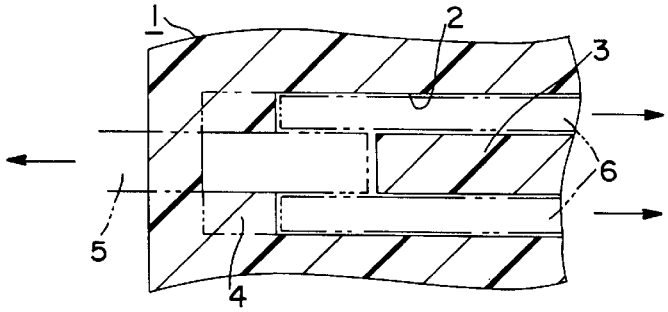
FIG. 18(A) PRIOR ART
FIG. 18(A) is a diagram of a generally used prior art connector.
Figure 18B:
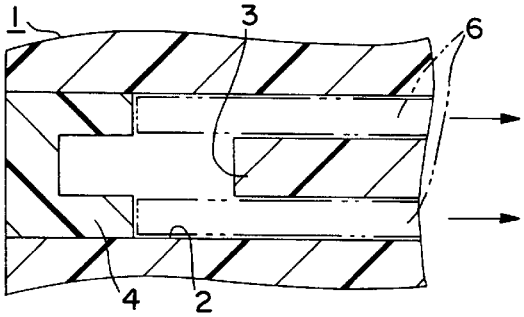
FIG. 18(B) PRIOR ART
FIG. 18(B) is a diagram showing an improvement made to make the connector of FIG. 18(A) smaller.

As a modification of the foregoing embodiment, backwardly projecting protrusions 70 may be formed at the rear ends of the partition walls 60, and recesses 71 for receiving the protrusions 71 may be formed in the back end surfaces of the notches 23, as shown in FIG. 17.

The partition walls 60 are formed with the substantially triangular positioning projections 61 in conformity with the substantially V-shaped positioning grooves 25 in the foregoing embodiment. However, the shapes of the positioning grooves 25 and the positioning projections 61 may be, for example, rectangular or semicircular. Further, instead of forming the grooves 25 as the positioning portions for the partition walls 60, a pair of positioning protrusions may be formed on the upper and lower surfaces of each notch 23 and the partition wall 60 may be positioned between the two positioning protrusions.

Although the holding member 50 also serves as a member for locking the rubber ring 30 in the foregoing embodiment, this holding member 50 is, of course, also applicable to a nonwatertight connector with no rubber ring.

Although the female connector provided with the receptacle 12 is described in the foregoing embodiment, the present invention is also applicable to female connectors with no receptacle and to male connectors.

What is claimed is:

1. A connector, comprising:

a housing with at least one cavity into which a terminal fitting is insertable, a lock projecting from an inner surface of the cavity for locking the terminal fitting inserted to a proper depth in the cavity, a retainer mount hole being formed in one side wall of the housing and communicating with the cavity;

a sealing ring mounted around an outer surface of the housing and closely contacting the housing and a mating housing fittable on the housing while being squeezed between the housings and the mating housing for providing a seal;

a holder mountable on the housing and provided with a stop wall for supporting the terminal fitting in the cavity at a limit position thereof and a sealing ring holding portion for holding the sealing ring so as not to come off by engaging the sealing ring from a fitting direction thereof; and a retainer for locking the terminal fitting in the cavity, the retainer being mountable in the retainer mount hole in a direction intersecting the fitting direction.

2. The connector of claim 1, wherein the housing has a front, the holder being mountable on the housing main body from the front, and wherein the stop wall is a front-stop wall for supporting the terminal fitting inserted into the cavity at a front-limit position.

3. The connector of claim 1, wherein the retainer comprises at least one auxiliary sealing ring holding portion for holding the sealing ring by engaging the sealing ring from the fitting direction.

4. The connector of claim 3, wherein the retainer is movable in the retainer mount hole between a partial locking position where a locking piece of the retainer is retracted from the cavity to permit the insertion and withdrawal of the terminal fitting into and from the cavity and a full locking position where the locking piece projects into the cavity to engage the terminal fitting.

5. The connector of claim 4, wherein the auxiliary sealing ring holding portion is formed by a front end and a rear end of the retainer with respect to the inserting direction thereof, wherein the rear end is engaged with the sealing ring from the fitting direction when the retainer is at the partial locking position, while both the front and rear ends are engaged with the sealing ring from the fitting direction when the retainer is at the full locking position, thereby holding the sealing ring.

6. A connector, comprising:

a housing with at least one cavity into which a terminal fitting is insertable, a lock projecting from an inner surface of the cavity for locking the terminal fitting inserted to a proper depth in the cavity;

a sealing ring mounted around an outer surface of the housing and closely contacting the housing and a mating housing fittable on the housing while being squeezed between the housings and the mating housing for providing a seal; and a holder mountable on the housing and provided with a stop wall for supporting the terminal fitting in the cavity at a limit position thereof and a sealing ring holding portion for holding the sealing ring so as not to come off by engaging the sealing ring from a fitting direction thereof, the holder comprising partition walls insertable at position adjacent to the locks along the fitting direction and substantially normal to a resilient deforming direction of the locks, the holder being insertable until reaching base ends of the locks, thereby forming side walls between the cavities, and wherein the housing comprises positioning portions engageable with the corresponding partition walls and extending along an inserting direction of the partition walls.

7. The connector of claim 6, wherein portions of adjacent cavities are at least partly divided by housing partition walls, wherein the respective partition wall of the holding member is insertable into a space of a corresponding notch provided in the housing partition wall.

* * * * *